US008393851B2

(12) United States Patent
Schlienger et al.

(10) Patent No.: US 8,393,851 B2
(45) Date of Patent: Mar. 12, 2013

(54) BURSTING PROTECTION

(75) Inventors: Joel Schlienger, Zurich (CH); Patrick Aberle, Untersiggenthal (CH)

(73) Assignee: ABB Turbo Systems AG, Baden (CH)

( * ) Notice: Subject to any disclaimer, the term of this patent is extended or adjusted under 35 U.S.C. 154(b) by 627 days.

(21) Appl. No.: 12/699,453

(22) Filed: Feb. 3, 2010

(65) Prior Publication Data

US 2010/0192570 A1 Aug. 5, 2010

(30) Foreign Application Priority Data

Feb. 4, 2009 (EP) ..... 09152067

(51) Int. Cl.
*F01B 25/16* (2006.01)

(52) U.S. Cl. ..... 415/9; 415/126; 415/203

(58) Field of Classification Search ..... 415/9, 126, 415/127, 128, 196, 197, 203, 204, 214.1
See application file for complete search history.

(56) References Cited

U.S. PATENT DOCUMENTS

| | | | | |
|---|---|---|---|---|
| 4,153,387 | A | 5/1979 | Weiler | |
| 5,354,173 | A * | 10/1994 | Reynolds | 415/205 |
| 2005/0100441 | A1 * | 5/2005 | Nguyen et al. | 415/204 |
| 2008/0304953 | A1 | 12/2008 | Chen et al. | |

FOREIGN PATENT DOCUMENTS

| | | | |
|---|---|---|---|
| DE | 10050931 | C1 | 8/2002 |
| DE | 102004028133 | A1 | 1/2006 |
| DE | 102005039820 | A1 | 3/2007 |
| EP | 1586745 | A1 * | 10/2005 |
| EP | 1719879 | A1 * | 11/2006 |
| EP | 2000633 | A2 | 12/2008 |
| FR | 2342397 | A | 9/1977 |
| GB | 2414769 | A | 12/2005 |
| WO | WO 02/090722 | A1 | 11/2002 |
| WO | WO 02090722 | A1 * | 11/2002 |

OTHER PUBLICATIONS

European Search Report for EP 09152067.6 dated Apr. 6, 2009.

* cited by examiner

*Primary Examiner* — Ninh H Nguyen
*Assistant Examiner* — William Grigos
(74) *Attorney, Agent, or Firm* — Buchanan Ingersoll & Rooney PC

(57) ABSTRACT

A compressor casing includes a casing insert with a flexible element in the force flux between the insert wall contour and the outer compressor casing. The flexible element is assembled from a support ring and ribs, wherein the ribs axially in front of the support ring and the ribs axially behind the support ring are arranged in an offset manner in relation to each other. Due to the arrangement of the ribs in an offset manner, the axial force flux between the insert wall contour and the outer compressor casing is deflected twice, and an axially compliant flexible construction is achieved.

17 Claims, 4 Drawing Sheets

BURSTING PROTECTION

RELATED APPLICATION

This application claims priority under 35 U.S.C. §119 to European Patent Application No. 09152067.6 filed in Europe on Feb. 4, 2009, the entire content of which is hereby incorporated by reference in its entirety.

FIELD

The present disclosure relates to the field of exhaust gas turbochargers for charged internal combustion engines, and more particularly, to a compressor of an exhaust gas turbocharger with a device for safeguarding the compressor-side bursting protection of the exhaust gas turbocharger.

BACKGROUND INFORMATION

Exhaust gas turbochargers are known to be used for increasing power of an internal combustion engine (combustion engine). An exhaust gas turbocharger can include a compressor which feeds air to the combustion chamber of the internal combustion engine for the combustion process, and an exhaust gas turbine in the exhaust gas tract of the internal combustion engine. With the charging of the internal combustion engine, the air and fuel volume in the cylinders is increased, and a noticeable power increase is produced for the internal combustion engine is produced as a result. The exhaust gas turbocharger is assembled from a rotor, which comprises a compressor impeller and a turbine wheel and also the shaft bearing, the flow-guiding casing sections (compressor casing, turbine casing), and the bearing housing.

If the internal combustion engine is operated under full load, and the exhaust gas turbine of the exhaust gas turbocharger is correspondingly exposed to a large exhaust gas flow, high circumferential speeds at the rotor blade tips of the turbine wheel and of the compressor impeller are reached. The maximum permissible rotor speed of a turbocharger is a function of the wheel size, the geometry and the strength values of the materials which are used. In general, the rotating components are subjected to high centrifugal force loads and therefore to high material stresses. Defects in the material microstructure can possibly lead to bursting of the compressor impeller or turbine wheel with unpredictable consequences for the adjacent casings.

The initial failure image of a compressor impeller can be described by a blade fracture or a multipiece hub burst. In the case of blade bursts, the blades fail in the root region of the compressor, wherein the impeller hub remains intact. In the case of multipiece hub bursts, the hub region can break into two to four fragments, for example. A significant case of compressor bursting is the 3-piece hub fracture with three fragments of approximately the same size (3×120° sectors). The burst protection concept (containment concept) of an exhaust gas turbocharger is designed to the effect that all the fragments, for the case of a multipiece hub burst, are retained within the outer casing shell at a prespecified burst speed. Thus, in the construction of the exhaust gas turbocharger, consideration is given to the fact that the kinetic energy of the compressor is already dissipated in the inner casing sections which are close to the rotor as a result of plastic deformation, and consequently the remaining kinetic energy of the radially outwardly thrown fragments is not sufficient to penetrate the outer casing shell or to cause the outer casing connections (for example bolts) to fail.

Different measures for the reduction of load of the casing connection in the case of a bursting compressor impeller are known.

According to WO 02/090722, a design break point is provided in the casing insert wall, which radially outwardly delimits the flow passage through the rotor blades of the compressor impeller, in order to prevent the axial spinning away of casing pieces or of components which are fastened on the compressor casing in the event of a compressor burst.

In EP 1-586-745, by means of a support flange and a sufficiently large distance of the support flange from the casing insert wall, a direct axial impulse transfer of flying-away compressor impeller pieces onto the air inlet casing taking place is prevented in the case of a bursting compressor impeller, and so the load of the upper connections between the casing sections is reduced and the breaking up of the connection and the emergence of fragments are prevented.

In a further variant according to GB 2-414-769, the axial load of the casing insert wall in the case of hub bursts is adequately absorbed by means of the long necked-down bolts, and the bolted flange connection between the compressor casing and the bearing housing is sufficiently unloaded.

In the variant according to DE 10-2004-028-133, such a necked-down bolt is provided with an additional precision fit between the bolt, the casing insert wall and the compressor casing. As a result of the precision fit, the circumferential forces which occur during bursting are absorbed, and rotation of the insert wall in relation to the compressor casing is avoided.

In DE 10-2005-039-820, the casing insert wall is supplemented with a retaining device in order to consequently trap or to jam the axially forwardly accelerated fragments of the compressor impeller and also of the casing insert wall.

The variants which are described above in most cases involve large constructional volumes for realizing the features which are described therein. Furthermore, in some variants, long necked-down, precision-fit bolts are used, which makes higher demands on the accuracy of casing manufacture, on the production costs and on the structural dimensions of the turbocharger. In DE 10-2005-039-820, DE 10-2004-028-133 and GB 2-414-769, the axially acting bursting forces are first absorbed by means of the necked-down precision-fit bolts and only then directed via the casing wall into the upper, shorter bolted connections between the compressor casing and bearing housing. These aforementioned bolted connections are the points of a compressor-side bursting concept which are to be protected.

SUMMARY

An exemplary embodiment provides a compressor of an exhaust gas turbocharger. The exemplary compressor comprises: a compressor impeller which is rotatable around an axis in an axial direction, and includes a hub; an outer compressor casing having an axial stop oriented toward the compressor impeller; a casing insert which is arranged radially outside the compressor impeller, where the casing insert including an insert wall contour which, in conjunction the hub of the compressor impeller, delimits a flow passage, wherein the casing insert abuts against the axial stop of the outer compressor casing; a flexible element configured to transfer axial forces from the insert wall contour to the outer compressor casing, the flexible element including at least two ribs which are axially oriented and arranged in an offset manner in relation to each other; and a support element which interconnects the ribs of the flexible element, the support element being oriented at an angle to the axial direction and being arranged between the ribs with regard to the axial direction.

BRIEF DESCRIPTION OF THE DRAWINGS

Additional refinements, advantages and features of the present disclosure are described in more detail below with reference to exemplary embodiments of the bursting concept for a compressor of an exhaust gas turbocharger as illustrated in the drawings, in which.

DETAILED DESCRIPTION

Exemplary embodiments of the present disclosure provide a casing connection of a compressor of an exhaust gas turbocharger. The casing connection is configured in a burst-proof manner so that, in the event of a failing compressor impeller by the outer casing connections between the compressor casing and the bearing housing, the casing connection protects against a failure.

According to an exemplary embodiment of the present disclosure, the casing connection comprises a casing insert which abuts against an axial stop of the outer compressor casing. A flexible element is provided in the force flux between the insert wall contour which delimits the flow passage and the outer compressor casing. The flexible element can be assembled from a support element which is oriented at an angle, such as substantially perpendicular, for example, to the axial direction. According to an exemplary embodiment, the flexible element can be formed as an encompassing support ring, and ribs which are located in front and behind in the axial direction. The ribs axially in front of the support element and the ribs axially behind the support element can be arranged in an offset manner in relation to each other in a direction perpendicular to the axial direction, for example, in the circumferential direction and/or in the radial direction. Due to the arrangement of the ribs in an offset manner, the burst-induced axial force flux between the insert wall contour and the outer compressor casing is deflected twice, and as a result, an axially compliant flexible construction is achieved. The axial load in the outer casing connections (bolts) is significantly reduced in the process.

During compressor bursts, the individual fragments press against the casing insert in the axial, radial and also circumferential directions. According to an exemplary embodiment of the present disclosure, the flexible element can be plastically axially deformed in the region of the encompassing ring and, consequently, kinetic bursting energy can be dissipated. In this way, only a fraction of the originally existing bursting energy, via the bearing faces of the fastening ribs of the casing insert, reaches the outer compressor casing and ultimately the connection to the bearing housing which is to be protected.

The bursting concept according to the disclosure, for the case of a compressor burst, makes provision for an installation space which is as small as possible and with a small number of standard bolts ensures a high axial unloading of the connection between the compressor casing and the bearing housing.

The kinetic energy which is released during the failure is primarily absorbed as a result of a plastic deformation of the inner casing sections. Consequently, the outer casing shell and the casing connecting bolts are unloaded to a large extent.

Figure 1:
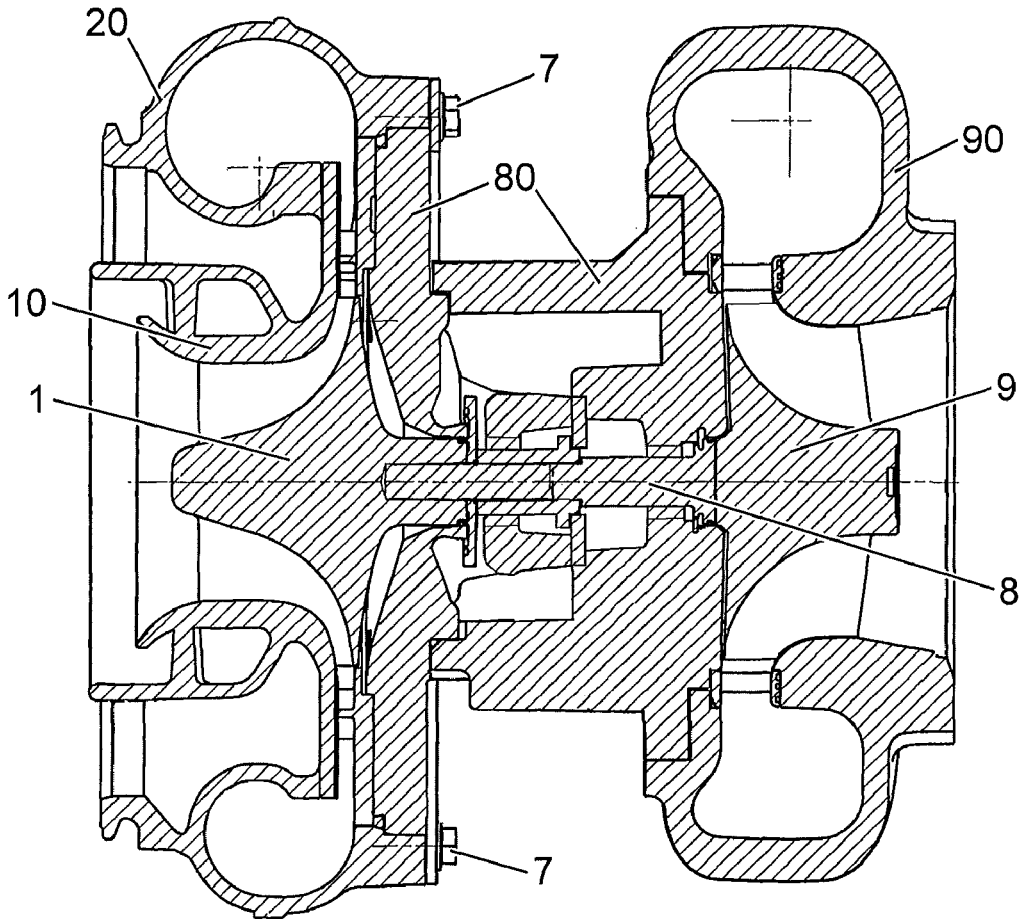
FIG. 1 shows a sectional view of a known exhaust gas turbocharger with a radial compressor having an outer compressor casing (scroll casing) and a casing insert as an inner compressor casing.

FIG. 1 shows a known exhaust gas turbocharger with a radial compressor and a radial turbine. The turbine wheel 9 is fastened on the shaft 8 or constructed in one piece with the shaft 8. The turbine casing 90 encloses the turbine wheel and delimits the flow passages which guide the hot exhaust gas from the internal combustion engine via the turbine wheel to the exhaust systems. The compressor impeller 1 is also fastened on the shaft 8. The compressor casing 10 is assembled from a plurality of casing sections and is fastened by bolts on the bearing housing by means of an outer fastening 7. Depending upon the construction concept, the multisection compressor casing is assembled in a specific sequence. In the configuration illustrated in FIG. 1, the inner compressor casing (i.e., the casing insert 10) is first inserted into the outer compressor casing (i.e., the scroll casing 20), and is fastened thereupon in a frictional locking or form-fitting manner with fastening means. After that, the unit consisting of the inner and outer compressor casings is pushed over the compressor impeller 1 which is already arranged on the shaft, and the unit is connected to the bearing housing 80. In the configuration of FIG. 1, the inner compressor casing 10, when connecting to the bearing housing in the region of the diffuser downstream of the compressor exit, can be optionally pressed via diffuser vanes 19 against a contact face of the bearing housing 80 and can therefore be clamped between the outer compressor casing 20 and the bearing housing 80 during operation.

Alternatively, there are construction concepts in which the inner compressor casing, that is to say the compressor insert, is subsequently inserted into the outer compressor casing, which is already connected to the bearing housing, and fastened on the outer compressor casing from the compressor side by means of bolts.

Figure 2:
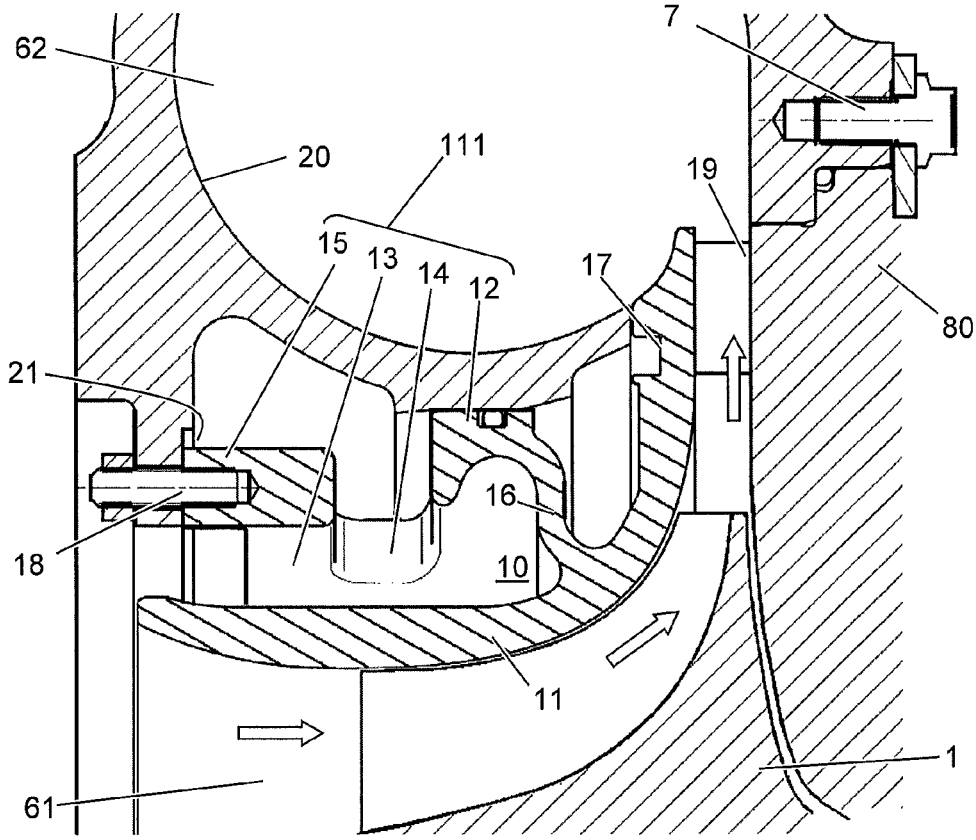
FIG. 2 shows a sectional view of a compressor casing with an outer compressor casing and an exemplary casing insert according to at least one embodiment of the present disclosure.

FIG. 2 shows an enlarged, sectional view of a compressor casing which is constructed to include features of the case illustrated in FIG. 1 but which has a casing insert (inner compressor casing) 10 which is designed according to an exemplary embodiment of the present disclosure, instead of the casing insert 10 illustrated in FIG. 1. As illustrated in FIG. 2, the casing insert 10 is fastened on the outer compressor casing (scroll casing) 20 and, in the case where a vaned diffuser 19 is used, can optionally be clamped between the outer compressor casing 20 and the bearing housing 80 via the vanes 19 of the diffuser. The casing insert 10 can be formed in one piece but comprise a plurality of functional sub-sections.

Radially towards the inside, the insert wall contour 11 delimits the flow passage 61. The air which is to be fed to the combustion chambers of the internal combustion engine therefore flows between the hub of the compressor impeller 1 and the insert wall contour 11. The insert wall contour 11, in the case of a radial compressor, is axially oriented in the inlet region and then extends in the radial direction in a curved manner and leads to a spiral-shaped collecting chamber 62 of the outer compressor casing. According to an exemplary embodiment, in the region of the diffuser downstream of the compressor exit, the insert wall contour 11 can be provided with a design break point 17 which, in the event of a burst of the compressor impeller, can break the insert wall contour 11 in a purposeful manner and thereby assist the energy dissipation which is provided inside the casing insert.

For centering of the casing insert 10 on the outer compressor casing 20, the casing insert comprises a centering ring 12 which rests against the outer compressor casing 20. The bearing face to the centering ring 12 can optionally be sealed by means of a sealing element (e.g., a sealing ring). As is shown in FIG. 2, the outer compressor casing 20 in the region of the bearing face to the centering ring can optionally have a cross section which becomes narrower towards the compressor inlet side (i.e., to the left in illustration of FIG. 2). As a result of this arrangement, in the event of a burst, a jamming of the centering ring 12 in the narrowing of the bearing face on the outer compressor casing can ensue. With such a jamming, some of the bursting energy can be dissipated in the region of the centering ring 12.

According to an exemplary embodiment, the centering ring 12 is connected via a connecting rib 16 to the inner insert wall contour 11. The connecting rib 16, as indicated in FIG. 2, can optionally be constructed in a double-curved configuration (e.g., S-shaped). In the event of a burst, the S-shape curved connecting rib 16 is highly flexurally loaded and, as a result, a high axial flexibility of the casing insert is achieved in the case of a burst-induced shock load upon the outer casing connections.

Axially oriented ribs 14 lead from the centering ring 12 to a support ring 13 which, via fastening ribs 15 which are also axially oriented, rests against an axial stop 21 of the outer compressor casing 20. According to an exemplary embodiment, the fastening ribs 15 can be optionally fastened on the outer compressor casing 20 by means of fastening means 18. According to an exemplary embodiment, the fastening means 18 can include, for example, bolts or threaded pins that are arranged in openings which are provided for the bolts or threaded pins in the fastening ribs 15. According to an exemplary embodiment, the support ring 13 can optionally be split into a plurality of ring segment-like support elements, which support elements then have at least one rib 14 on each of the two axial end faces, wherein the ribs 14 are arranged in an offset manner in relation to each other on the opposite end faces.

The ribs 14 are distributed along the periphery of the support ring 13 between the support ring 13 and the centering ring 12. The fastening ribs 15 are also distributed along the periphery of the support ring 13 but are arranged in an offset manner in relation to the ribs 14. The fastening ribs 15 and the ribs 14 can optionally also be arranged in an offset manner in relation to each other in the radial direction in addition to, or instead of, the offset in the circumferential direction.

Figure 3:
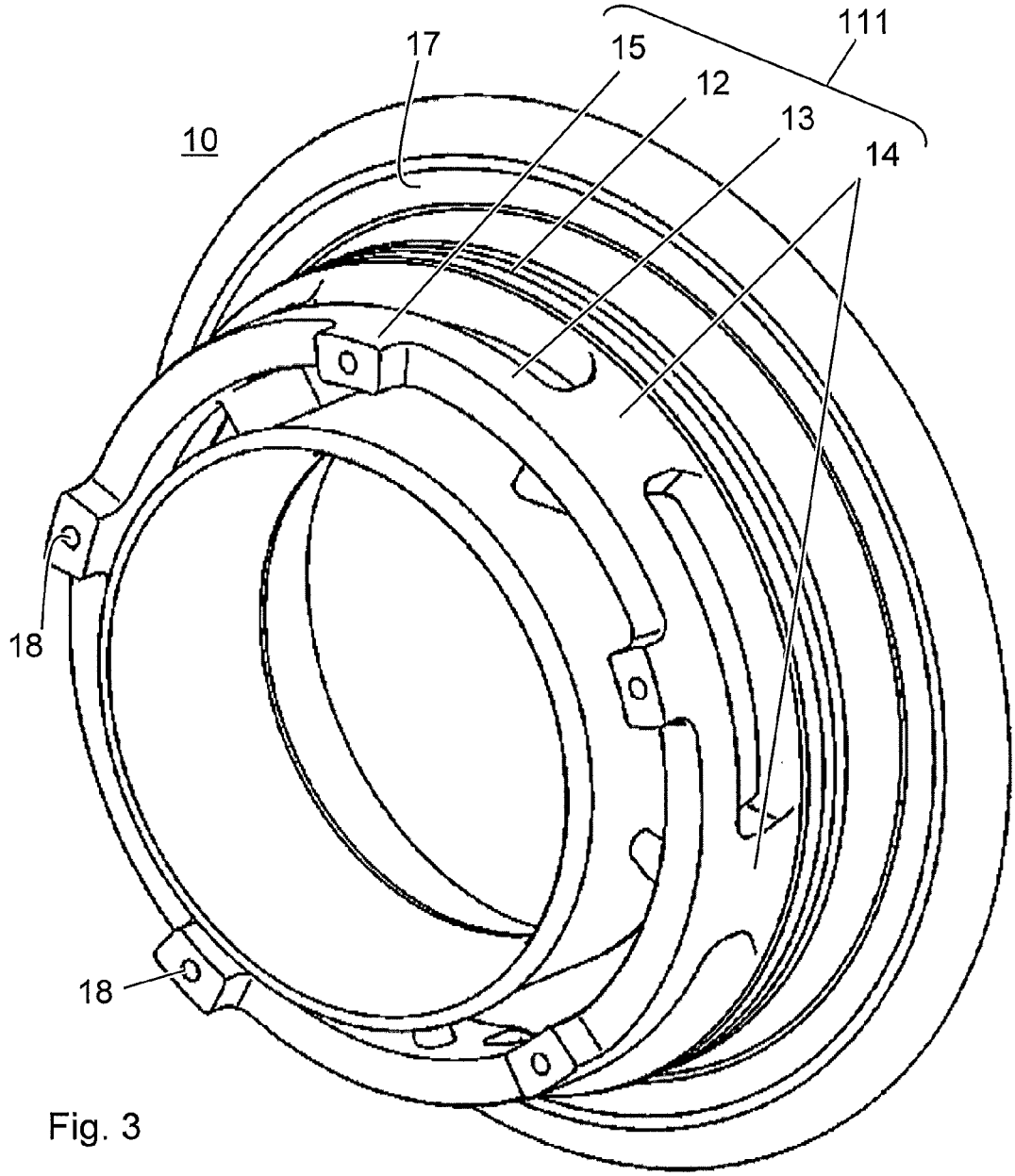
FIG. 3 shows an isometric view of the exemplary casing insert illustrated in FIG. 2.
Figure 4:
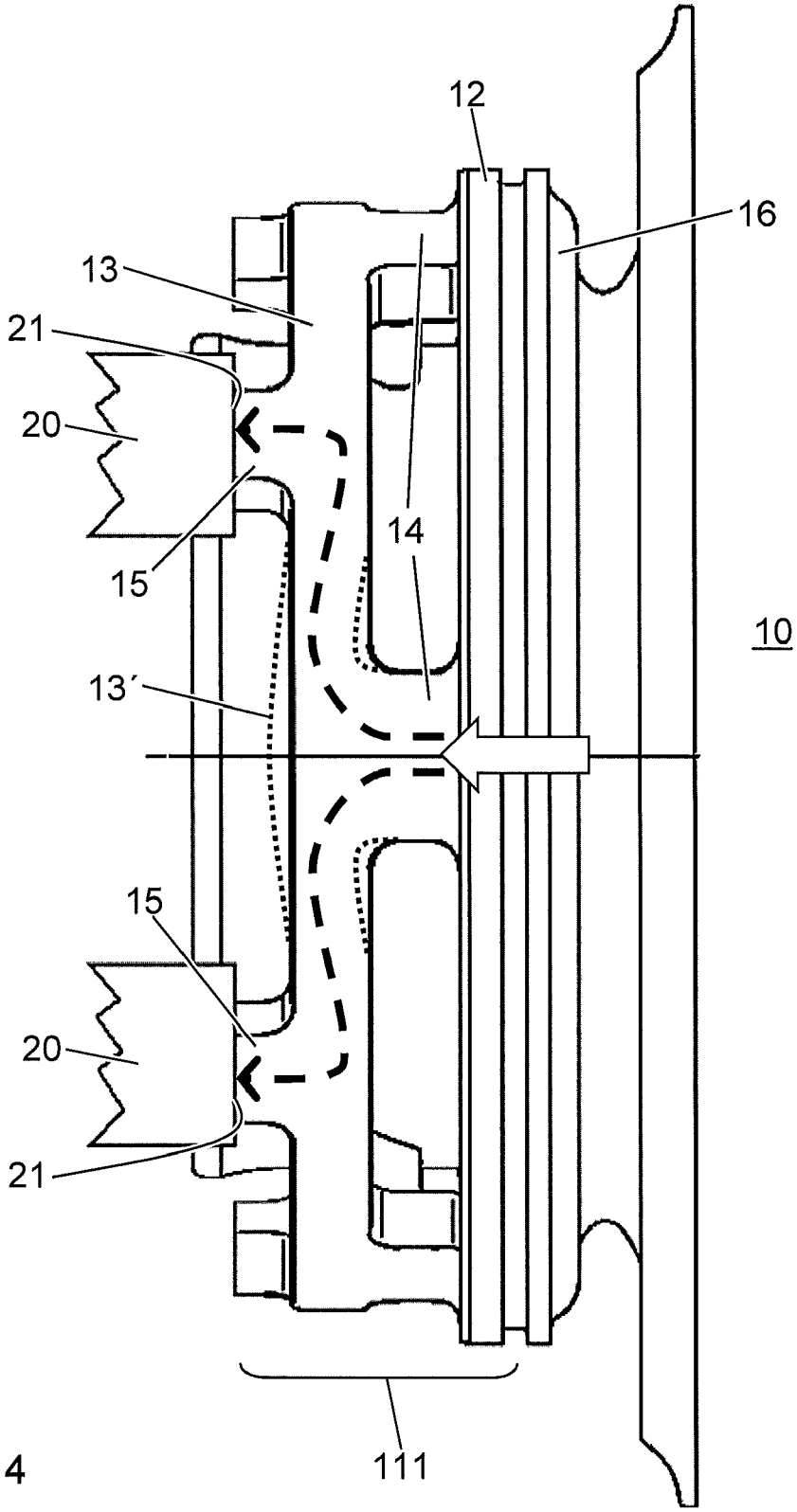
FIG. 4 shows a side view in the radial direction of the exemplary casing insert illustrated in FIG. 2, with distortion indicated in the event of a burst.

The fastening ribs 15, the support ring 13, the ribs 14 between the support ring 13 and the centering ring 12, and the centering ring 12 together form a flexible element 111. FIGS. 3 and 4 show an enlarged perspective of the exemplary casing insert 10 of the present disclosure with the flexible element construction. According to an exemplary embodiment, the ribs of the flexible element 111 are offset in the circumferential direction in each case by half a pitch. Due to this offset, the force flux between the centering ring 12 and the axial stop 21 on the outer compressor casing 20 is deflected twice via the ribs 14 between the centering ring 12 and the support ring 13, the encompassing support ring 13, and also the fastening ribs 15. Consequently, an axially compliant flexible construction is achieved by this exemplary arrangement.

During compressor bursts, the casing insert 10 can be rotated in the circumferential direction as a result of the impingement of the compressor impeller fragments, which can lead to a shearing off of the connection 18 between the fastening ribs 15 and the outer compressor casing and therefore to a partial dissipation of the kinetic bursting energy. The axial bursting forces are directed via the casing insert 10 into the outer compressor casing 20 and finally into the outer casing connection 7. In order to prevent an outward escape of the fragments, it is therefore always to be ensured that the casing connection 7 remains intact and holds together the bearing housing 80 and the outer compressor casing 20. In order to achieve this, according to an exemplary embodiment of the present disclosure, a large part of the energy in the casing insert is dissipated. The fragments which are thrown outwards can be wedged between the casing insert 10 and the bearing housing 80 in such a way that high axial forces near to the casing insert 10 also load the outer compressor casing 20 and the bearing housing 80. First of all, however, the fragments of the compressor impeller 1 load the insert wall contour 11. According to an exemplary embodiment, the axial forces are transferred to the centering ring 12 via the connecting rib 16.

From the centering ring 12, the axial forces are again transferred via the ribs 14 to the support ring 13. The encompassing support ring 13 is subsequently plastically deformed in the region of the connection to the ribs 14, as is indicated in FIG. 4 with reference to the dotted path of the support ring 13'. As a result of the plastic deformation of the support ring 13, kinetic bursting energy is dissipated. In this way, only a fraction of the originally existing bursting energy, via the bearing faces of the fastening ribs 15, reaches the outer compressor casing 20 and ultimately the casing connection 7 which is to be protected in the radially outer region of the compressor casing.

According to an exemplary embodiment, the ribs 14 and the rings 13 of the flexible element 111 are constructionally designed so that for normal turbocharger operation, a sufficiently high strength is achieved and the insert wall is to be assumed as rigid, whereby the clearances between the compressor impeller 1 and the casing are not negatively affected. Furthermore, in the exemplary design of the flexible element 111, consideration is to be given to the fact that the natural frequencies of the insert wall which are achieved do not come to lie within the frequency range of the engine-induced excitation spectrum. The casing insert 10 can be constituted by a cast material (for example GGG-40).

The insert wall contour 11 can optionally delimit a cavity, which radially encompasses the flow passage 61, from the flow passage, in which cavity partially compressed air from the region of the compressor impeller 1 blades can already be fed back into the intake region. For this purpose, an at least partially encompassing slot in the region of the compressor impeller blades can optionally be let into the insert wall contour.

Instead of the support ring which is oriented strictly perpendicularly to the axial direction, an exemplary embodiment of the present disclosure provides a support ring which is oriented at an angle, such as at an angle in the range of between 60° and 90°, for example, to the axial direction and which can also be deformed and consequently can absorb bursting energy.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

1 Compressor impeller

7 Fastening of the compressor casing on the bearing housing

8 Shaft
9 Turbine wheel
10 Casing insert (inner compressor casing)
11 Insert wall contour
12 Centering ring
13 Support element, support ring
14 Rib
15 Fastening rib
16 Connecting rib
17 Design break point
18 Fastening means (hole/bolt)
19 Diffuser vane
20 Scroll casing (outer compressor casing)
21 Axial stop
61 Flow passage
62 Collecting chamber in the scroll casing
80 Bearing housing
90 Turbine casing
111 Flexible element

What is claimed is:

1. A compressor of an exhaust gas turbocharger, the compressor comprising:

a compressor impeller which is rotatable around an axis in an axial direction, and includes a hub;

an outer compressor casing having an axial stop oriented toward the compressor impeller;

a casing insert which is arranged radially outside the compressor impeller, the casing insert including an insert wall contour which, in conjunction the hub of the compressor impeller, delimits a flow passage, wherein the casing insert abuts against the axial stop of the outer compressor casing;

a flexible element configured to transfer axial forces from the insert wall contour to the outer compressor casing, the flexible element including at least two ribs which are axially oriented and arranged in an offset manner in relation to each other; and a support element which interconnects the ribs of the flexible element, the support element being oriented at an angle to the axial direction and being arranged between the ribs with regard to the axial direction.

2. The compressor as claimed in claim 1, wherein the flexible element comprises a ring segment-like support element, which is oriented in the circumferential direction of the compressor impeller, and wherein the support element includes a plurality of axially oriented ribs on one axial side and at least one axially oriented rib on another axial side of the support element.

3. The compressor as claimed in claim 1, wherein the flexible element comprises a ring-like support element, which is arranged in the circumferential direction of the compressor impeller, and wherein the support element has a plurality of axially oriented ribs on two axial sides of the support element.

4. The compressor as claimed in claim 1, wherein the support element is oriented perpendicularly to the axial direction and is arranged between the ribs with regard to the axial direction.

5. The compressor as claimed in claim 4, wherein the flexible element comprises a ring segment-like support element, which is oriented in the circumferential direction of the compressor impeller, and wherein the support element has a plurality of axially oriented ribs on one axial side and at least one axially oriented rib on another axial side of the support element.

6. The compressor as claimed in claim 4, wherein the flexible element comprises a ring-like support element, which is arranged in the circumferential direction of the compressor impeller, and wherein the support element has a plurality of axially oriented ribs on two axial sides of the support element.

7. The compressor as claimed in claim 1, wherein the flexible element is arranged in a force flux between the insert wall contour and the axial stop to transfer axial forces from the insert wall contour to the axial stop of the outer compressor casing.

8. The compressor as claimed in claim 1, wherein the flexible element is part of the outer compressor casing, and wherein the axial stop is arranged in a force flux between the insert wall contour and the flexible element to transfer axial forces from the insert wall contour to the outer compressor casing.

9. The compressor as claimed in claim 1, wherein the flexible element comprises an encompassing centering ring, which is connected via a connecting rib to the insert wall counter, to transfer axial forces from the insert wall contour to the flexible element.

10. The compressor as claimed in claim 9, wherein the connecting rib between the insert wall contour and the flexible element is formed in a double-curved configuration.

11. An exhaust gas turbocharger, comprising a compressor as claimed in claim 1.

12. The compressor as claimed in claim 2, wherein the flexible element is arranged in a force flux between the insert wall contour and the axial stop to transfer axial forces from the insert wall contour to the axial stop of the outer compressor casing.

13. The compressor as claimed in claim 6, wherein the flexible element is arranged in a force flux between the insert wall contour and the axial stop to transfer axial forces from the insert wall contour to the axial stop of the outer compressor casing.

14. The compressor as claimed in claim 6, wherein the flexible element is part of the outer compressor casing, and wherein the axial stop is arranged in a force flux between the insert wall contour and the flexible element to transfer axial forces from the insert wall contour to the outer compressor casing.

15. The compressor as claimed in claim 6, wherein the flexible element comprises an encompassing centering ring, which is connected via a connecting rib to the insert wall counter, to transfer axial forces from the insert wall contour to the flexible element.

16. The compressor as claimed in claim 10, wherein the connecting rib between the insert wall contour and the flexible element is formed in an S-shaped axial profile.

17. An exhaust gas turbocharger, comprising a compressor as claimed in claim 6.

* * * * *